US007854545B2

(12) United States Patent
Albano

(10) Patent No.: US 7,854,545 B2
(45) Date of Patent: Dec. 21, 2010

(54) WRISTWATCH FEATURING A CASE THE BACK OF WHICH CAN HOUSE A STONE IN CONTACT WITH THE SKIN

(75) Inventor: Francesco Albano, Milan (IT)

(73) Assignee: Frankstone Srl, Peschiera Borromeo (MI) (IT)

( * ) Notice: Subject to any disclaimer, the term of this patent is extended or adjusted under 35 U.S.C. 154(b) by 117 days.

(21) Appl. No.: 12/309,042

(22) PCT Filed: Jul. 5, 2007

(86) PCT No.: PCT/IT2007/000486

§ 371 (c)(1),
(2), (4) Date: Feb. 13, 2009

(87) PCT Pub. No.: WO2008/004268

PCT Pub. Date: Jan. 10, 2008

(65) Prior Publication Data

US 2009/0303843 A1 Dec. 10, 2009

(30) Foreign Application Priority Data

Jul. 7, 2006 (IT) ..... RM20060130 U

(51) Int. Cl.
*G04B 37/00* (2006.01)
*G04B 37/12* (2006.01)

(52) U.S. Cl. ..... 368/309; 368/281

(58) Field of Classification Search ..... 368/276, 368/280–283, 285, 297–298, 309–313
See application file for complete search history.

(56) References Cited

U.S. PATENT DOCUMENTS

| | | | | |
|---|---|---|---|---|
| 4,390,288 | A | 6/1983 | Arnoux | |
| 4,525,077 | A * | 6/1985 | Ketner | 368/77 |
| 4,620,798 | A * | 11/1986 | Scarinzi | 368/276 |
| 4,740,935 | A * | 4/1988 | Gogniat | 368/294 |
| 4,862,435 | A * | 8/1989 | Reichel et al. | 368/282 |
| 4,956,830 | A * | 9/1990 | Mock et al. | 368/280 |
| 4,967,402 | A * | 10/1990 | Claude | 368/280 |
| 5,901,117 | A * | 5/1999 | Delabre | 368/276 |
| 5,943,302 | A * | 8/1999 | Fanshaw | 368/276 |
| 6,666,576 | B2 * | 12/2003 | Kaelin et al. | 368/295 |
| 2002/0110050 | A1 * | 8/2002 | Fernandez | 368/281 |
| 2004/0095851 | A1 | 5/2004 | Eller | |

FOREIGN PATENT DOCUMENTS

| | | |
|---|---|---|
| DE | 299 01 782 U1 | 4/1999 |
| DE | 202 20 899 U1 | 6/2004 |
| WO | WO 2004/055602 | 7/1994 |

* cited by examiner

*Primary Examiner*—Vit W Miska
*Assistant Examiner*—Sean Kayes
(74) *Attorney, Agent, or Firm*—Breiner & Breiner, LLC

(57) ABSTRACT

The present invention provides a wristwatch the case back of which is designed as a seat for a stone of the same shape and size and the stone is fitted to the case by a ring, which allows the stone to project a few millimeters so that the stone is in contact with the skin of the wrist.

5 Claims, 2 Drawing Sheets

WRISTWATCH FEATURING A CASE THE BACK OF WHICH CAN HOUSE A STONE IN CONTACT WITH THE SKIN

Crystal therapy is an ancient healing practice using gems, precious stones and crystals to prevent and cure a number of disorders.

Many consider that stones can emit large quantities of subtle energy that can be transmitted to the human body by absorbtion.

Stones can be used to help relaxation and stress release, to help concentration during meditation routines, to enhance energy flows in the body and to help maintain an overall state of mental and physical balance.

Crystal therapy is based on a theory according to stones are a powerful source of energy vibrations, each stone featuring a different frequency and specific therapeutic properties, which can affect the person wearing it by resonance.

The body is capable of absorbing and using the energy released by the single stones by 'capturing' the vibrational waves and sending them on to any points with energy blocks or unbalances.

The positive energy vibrations of the stones can be assimilated by the body, especially through the skin, by direct contact.

Until today stones could be placed on the skin only during special treatments or they could be worn as items of jewelry, alternatively to or in continuation of the treatment, as pendants or the like.

Stones have also been fastened to special supports, such as belts, and kept in contact with the body.

However, not all people like wearing wrist or ankle bracelets, necklaces, etc., especially men, for whom such accessories are not customary, for which reason many people find it hard to effectively exploit the properties of stones. Moreover, it must also be kept in mind that the tighter in contact with the body the stone is worn, the greater and more effective the absorbtion of the vibrations released.

According to the present invention there is provided a wristwatch the case back of which is designed as a seat for a stone of the same shape and size and the stone is fitted to the case by means of a ring, which allows the stone to project for a few millimetres so that it is in contact with the skin of the wrist.

A specific embodiment of the invention will now be described by way of example with reference to the accompanying drawing in which.

Figure 1:
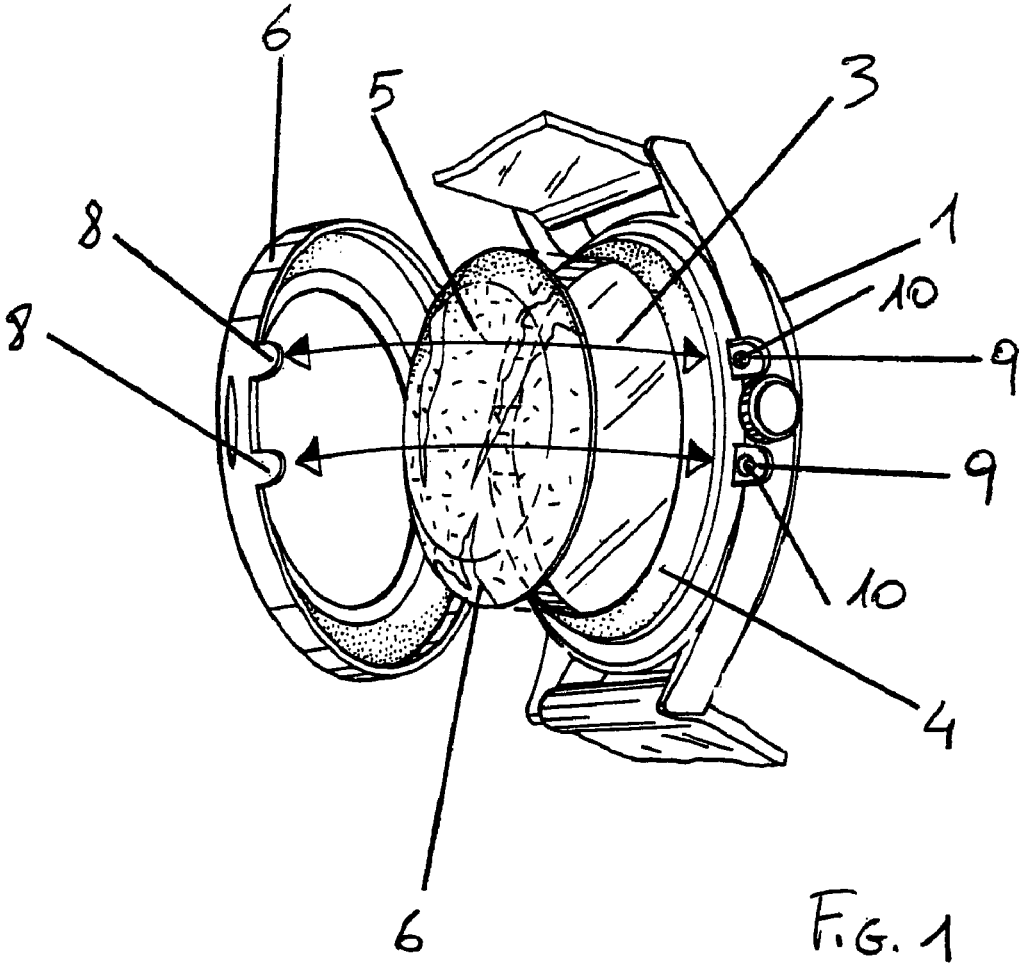
FIG. 1 shows an exploded diagram of the wristwatch case back in open position with the stone and the fastening ring.
Figure 2:
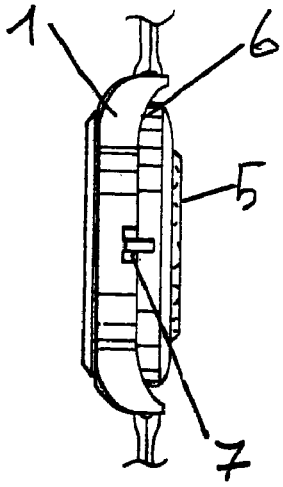
FIG. 2 shows a side view of the wristwatch with the hinge of the ring.
Figure 3:
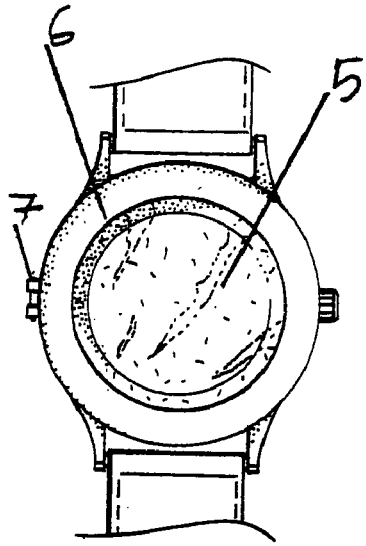
FIG. 3 shows a view from the top of the case back.
Figure 4:
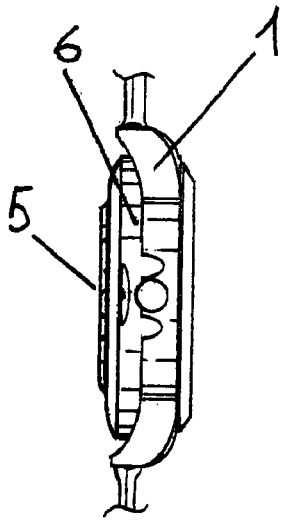
FIG. 4 shows a side view of the wristwatch from the side of the wristwatch crown.
Figure 5:
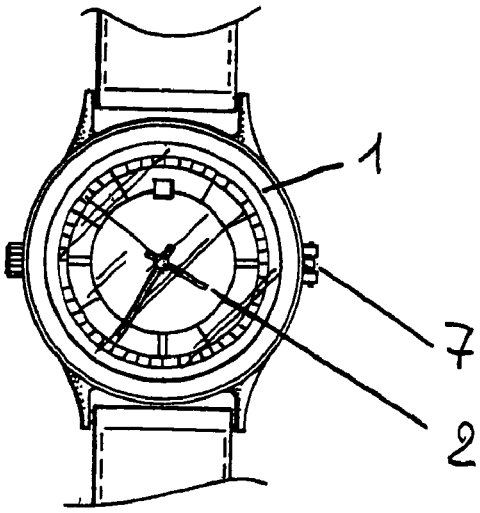
FIG. 5 shows a view of the wristwatch face up.

Referring to the drawing the wristwatch (1) features a case body the front of which (2) is conventional while the back features a seat (3) around the external circumference of which there is a collar (4).

The seat (3) houses the stone (5) which is kept in place by means of a ring (6). The size and shape of the stone (5) are such as to ensure a perfect fit inside the seat (3) and that its upper face, which is slightly smaller than the lower one, projects slightly from the ring (6).

In short, the internal diameter of the empty part of the ring (6) is slightly smaller than the internal diameter of the seat (3) so that when the ring (6) is placed and fastened around the stone (5) housed in the seat (3) it remains firmly in place.

To make it easy to open and close the ring (6) it is hinged to the edge of the wristwatch case body (1) by means of a hinge (7), which can be rotated by 90°.

On the opposite side of the hinge (7) the ring (6) features two rigid tongues (8), which, in the closed position, fit into the seats (9) on the case body (1); the seats (9) are provided with two elastic fastening devices (10), which, by pressing against the tongues (8) prevent the accidental opening of the ring (6). Obviously, the ring (6) can be fastened to the case body in a different manner, for example, it can be threaded so that it can be fastened by screwing it around the collar (4); alternatively, the ring (6) may be entirely removable and fastened to the case body (1) by means of a joint.

It is also obvious that, although this embodiment of the invention has been described and illustrated with reference to a wristwatch with a round case, the proposed invention can be fitted to any case shape.

In the event the wristwatch case is shaped differently from the described embodiment, the stone (5) and the ring (6) shall be shaped accordingly.

The invention claimed is:

1. A wristwatch comprising: a case enclosing a timepiece movement, the case comprises a front side with a time display, and a back side with a seat and a collar extending around an external circumference of the seat; a stone located inside the seat; a ring located around the collar, the ring has an inner radius which is less than an outer radius of a lower face of the stone so as to hold the stone in place against the seat; the seat and the lower face of the stone are sized and shaped to ensure a perfect fit of the stone inside the seat; and an upper face of the stone is shaped such that the stone extends through the ring of the wristwatch and a plurality of millimeters beyond the ring so that when the wristwatch is worn the stone comes into contact with skin of a wearer of the wristwatch.

2. The wristwatch as claimed in claim 1, wherein the ring is hinged to the body of the case.

3. The wristwatch as claimed in claim 1, wherein the ring includes two rigid tongues which, when the ring is in a closed position on the case, the two rigid tongues engage two elastic fasteners present in respective seats.

4. The wristwatch as claimed in claim 1, wherein the ring is threaded so that the ring is screwable onto the body of the case.

5. The wristwatch as claimed in claim 1, wherein the ring includes fastening devices for fastening to the body of the case.

* * * * *